United States Patent [19]

Juergens et al.

[11] Patent Number: 4,724,927

[45] Date of Patent: Feb. 16, 1988

[54] SUCTION HOUSING OF A LUBRICATING-OIL PUMP FOR THE LUBRICATING-OIL STORAGE TANK OF A MOTOR VEHICLE

[75] Inventors: Gunter Juergens, Waiblingen; Ruediger Giesen, Althuette; Alfred Wabel, Stuttgart, all of Fed. Rep. of Germany

[73] Assignee: Daimler-Benz Aktiengesellschaft, Stuttgart, Fed. Rep. of Germany

[21] Appl. No.: 854,608

[22] Filed: Apr. 22, 1986

[30] Foreign Application Priority Data

Apr. 22, 1985 [DE] Fed. Rep. of Germany ..... 3514499

[51] Int. Cl.[4] ..... F01M 3/00; F01M 1/10; F16K 21/04; F16B 19/00

[52] U.S. Cl. ..... 184/6.2; 184/6.24; 137/38; 137/533.21; 411/508

[58] Field of Search ..... 184/6.21, 6.24, 6.2, 184/6.4, 106; 137/38, 533.21; 411/508–510, 339

[56] References Cited

U.S. PATENT DOCUMENTS

| | | | |
|---|---|---|---|
| 1,045,619 | 11/1912 | Schweizer | 137/533.21 |
| 1,222,579 | 4/1917 | Pratt | 137/533.21 |
| 1,674,103 | 6/1928 | Frederick | 184/6.2 |
| 2,022,898 | 12/1935 | Niven | 184/6.2 |
| 2,938,601 | 5/1960 | Brafford | 184/6.2 |
| 3,656,665 | 4/1972 | Fleming | 137/38 |
| 3,745,612 | 7/1973 | Seckerson | 411/509 |
| 4,023,548 | 5/1977 | Prasch | 184/6.2 |
| 4,174,699 | 11/1979 | Gill | 184/6.4 |
| 4,470,737 | 9/1984 | Wollar | 411/508 |
| 4,499,636 | 2/1985 | Tanaka | 411/508 |

FOREIGN PATENT DOCUMENTS

| | | | |
|---|---|---|---|
| 1238270 | 4/1967 | Fed. Rep. of Germany | 184/6.2 |
| 2339730 | 2/1974 | Fed. Rep. of Germany . | |
| 646076 | 2/1979 | U.S.S.R. | 184/6.2 |

*Primary Examiner*—Carlton R. Croyle
*Assistant Examiner*—Jane E. Obee
*Attorney, Agent, or Firm*—Barnes & Thornburg

[57] ABSTRACT

This invention relates to a suction housing of a lubricating-oil pump inserted in a lubricating-oil storage tank of an aggregate of vehicles having a distributing regulator with a mass that is guided in the direction of the accelerating forces affecting the vehicle for the regulating of valve openings. In order to obtain a suction housing with a low overall height and a simple arrangement of valves, the distributing regulator is developed to be plate-shaped in which case the valves are movably suspended at the sides of the distributing regulator.

15 Claims, 2 Drawing Figures

SUCTION HOUSING OF A LUBRICATING-OIL PUMP FOR THE LUBRICATING-OIL STORAGE TANK OF A MOTOR VEHICLE

BACKGROUND AND SUMMARY OF THE INVENTION

This invention relates to a suction housing of a lubricating-oil pump inserted into the lubricating-oil storage tank of vehicles having a distributing regulator that is guided in the suction housing and suction openings which are controlled by valves such that the suction opening that faces away from the moving direction of the distributing regulator can be closed to prevent air intake.

A suction housing of the above-mentioned type is described in German Published unexamined Application (DE-OS) No. 233 97 30. Accordingly, by means of a distributing regulator having a mass, a suction opening located in the direction of the acceleration affecting a vehicle is closed in order to prevent an intake of air to the oil pump. However, the problem occurs that, because of their design, the valves arranged at the ends of the guiding part of the distributing regulator cannot ensure perfect sealing, mainly with respect to the penetration of air, without a special and thus costly perfecting of the valve seats at the suction housing. In addition, the design of the valves according to the above-mentioned German Application requires a large overall height, resulting in the fact that the suction openings that can be closed by the valves cannot lie deep enough in the oilpan. For this reason, separate additional spaces are also provided into which one intake connection leads and through which the lubricating oil, via a suction pipe, is sucked from more deeply located areas of the lubricating-oil tank. This then has the result that in the case of defect in a valve, this valve cannot simply be removed but the complete device must be replaced. Moreover, an oil filter arranged above the device results in such large dimensions that a use in an automatic transmission is inconceivable.

Due to the fact that almost the whole mass of the distributing regulator is combined in the two valves mounted on it, the distributing regulator must be guided very narrowly in order to prevent a tilting when the play is too large because of its small diameter. However, a disadvantage of this arrangement is that this narrow guiding increases the friction resistance, resulting in the expectance of a poor response of the distributing regulator when accelerations occur.

It is an objective of the invention to improve the suction housing known from the above-mentioned German Application in such a way that a low overall height is obtained and the valves mounted at the distributing regulator, without any special perfecting of the valve seats, ensure a perfect sealing, especially with respect to the air intake in the suction housing.

This objective is achieved according to the invention by developing the distributing regulator to be plate-shaped and by movably suspending the valves at their sides facing the suction openings.

The plate-shaped construction of the distributing regulator permits an extremely flat design so that separate additional spaces and intake pipes leading into them for the picking-up of deeper oil layers are not necessary. Thus, a defective valve can be exchanged without problems and without having to replace the whole device. Another advantage of this flat design is that the device is especially well-suited for use in automatic transmissions.

The movable suspension of the valves and the seals, that are injection-molded onto the closing plates of the valves, ensure a perfect sealing of the suction openings without requiring a special perfecting of the valve seats.

According to preferred embodiments of the invention, the valves consist of a closing plate with a two-pronged radially biased bolt fastened to its. The bolt can be pressed together and be inserted through the suction opening into a T-shaped recess in the housing. Due to this construction, in the case of a development according to Claim 2, a defective valve can simply be pulled out of the receiving opening in the distributing regulator and be exchanged.

The slot-shaped development of the suction openings ensures a largest possible inlet cross-section with a low overall height.

By the guiding of the distributing regulator in a shallow groove with a distributing regulator that is equipped with a sliding layer in the direction of the underside, a response of the distributing regulator is achieved even in the case of low accelerations. In this case, a development of the sliding layer in the form of Teflon naps has the effect that the distributing regulator already starts moving at an angle of slope of the suction housing of about 2°.

Other objects, advantages and novel features of the present invention will become apparent from the following detailed description of the invention when considered in conjunction with the accompanying drawings.

DETAILED DESCRIPTION OF THE DRAWINGS

Figure 1:
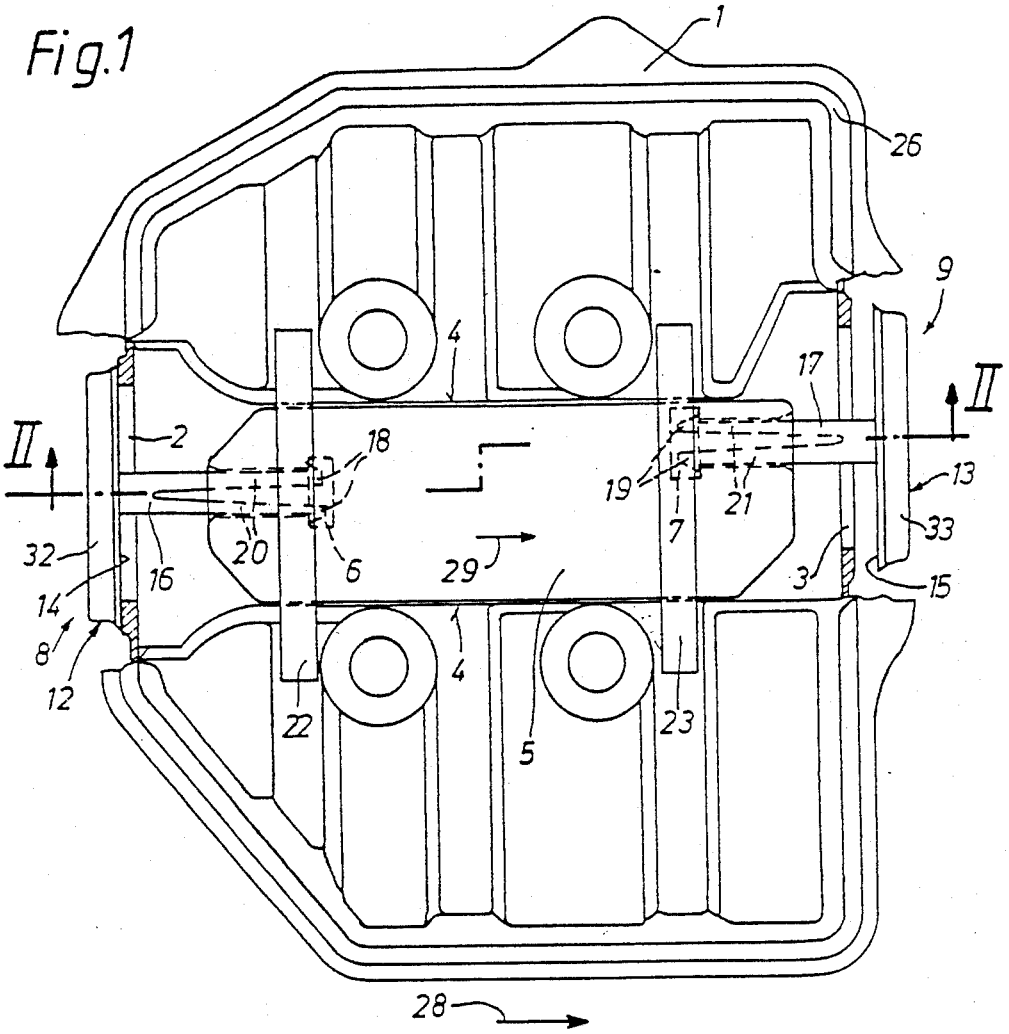
FIG. 1 is a schematic top view of the bottom part of a suction housing of a lubricating-oil pump according to the invention inserted in the lubricating-oil tank of a vehicle aggregate.
Figure 2:
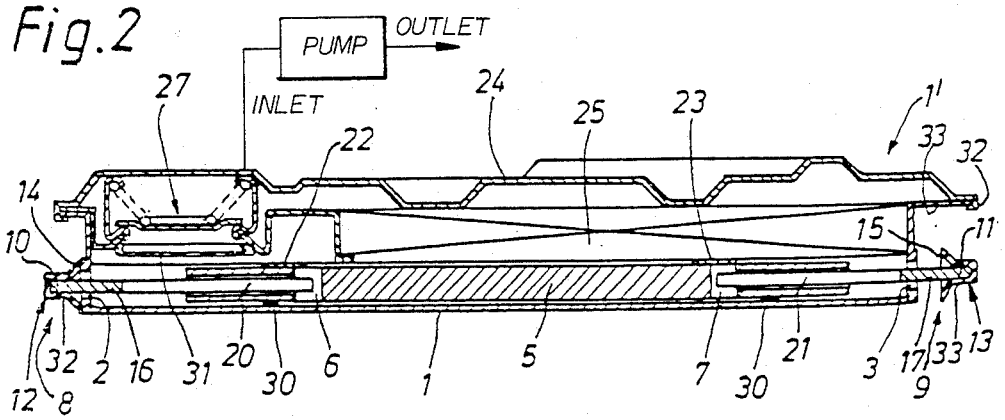
FIG. 2 is a cross-sectional view along the line II—II in FIG. 1 of a suction housing of a lubricating-oil pump according to the invention inserted in the lubricating-oil storage container of a vehicle aggregate having an installed filter element and by-pass valve.

FIG. 1 shows a bottom part 1 of a suction housing 1' that in FIG. 2 is shown in cross-sectional view, said suction housing 1' having two suction openings 2 and 3 in which a shallow groove 4 serves as a guide rail for a plate-shaped distributing regulator 5 having a mass. This distributing regulator 5, at its two sides facing the suction openings 2 and 3, in each case has a T-shaped recess 6 and 7 in which a valve 8 and 9 is movably suspended. The valve 8 and 9 consists of a closing plate 10 and 11 and a two-pronged radially outwardly biased bolt 16 and 17 with a rectangular cross-section. This closing plate 10 and 11, visible in FIG. 2, has a sealing means 12 and 13 injection-molded onto it. A movable suspension is achieved by the fact that the two-pronged radially biased bolt 16 and 17 of a valve 8 and 9, on the side facing away from the suction opening 2 and 3, is developed as a U-profile having two "barbs" 18 and 19 so that it can be clipped with vertical and horizontal play into the T-shaped recess 6 and 7 at the distributing regulator 5 by means of the pressing-together of the prongs 20 and 21 forming the U-profile.

Above the distributing regulator 5, perpendicular to its moving direction, two brackets 22 and 23 are clamped and fastened at the bottom part of the housing.

FIG. 2 shows the device according to FIG. 1 in a cross-sectional view, with a cover 24 closing the housing 1' in upward direction. A filter element 25 is mounted above the distributing regulator 5, said filter element 25 resting on a supporting shoulder 26 shaped onto the interior contour of the housing. A by-pass valve 27 is arranged in parallel that connects the suction openings 2 and 3 directly with the intake connection (not shown) mounted in the housing cover 24.

The Arrow 28 marks an assumed driving direction of a vehicle. When the vehicle is braked, for example, an accumulation of lubricating oil occurs in the area of the valve 9 because of this deceleration. The braking of the vehicle also has the effect that force affects the distributing regulator 5 that causes it to move in the direction of the Arrow 29 and causing the suction opening, on the side of which there will now be less lubricating oil, to be closed by the valve 8. An oil pump (that is not shown here) thus sucks in the lubricating oil only via the suction opening 3. By means of the movable valve 8 with its molded-on sealing means 12, an optimal sealing of the suction opening 2 is achieved, making it impossible for the valve 8 to take in air.

Four Teflon (polytetrafluoroethylene) naps or slides 30 attached at the underside of the regulating distributor 5 cause a response of the regulating distributor 5 even in the case of low accelerations. The two brackets 22 and 23 avoid a tilting of the distributing regulator 5 because of possibly occurring accelerations perpendicular to its moving direction. The filter element 25 arranged in the housing 1' above the distributing regulator 5 sifts out impurities in the lubricating oil before it enters the oil pump. When the filter element 25 has reached a certain degree of accumulation of impurites, the by-pass valve 27 that is arranged in parallel to the filter element 25 opens up, and the oil flows from the respective suction opening 2 and 3 directly, via the by-pass valve 27, to the oil pump. The by-pass valve 27, which has a sieve 31 connected in front of it, has the purpose of ensuring that the oil flow does not fall under a certain required minimum.

The edge 32 of the upper part 24 of the housing is flanged over the edge 33 of the bottom part 1 and is glued together with it. Replacing the valves 8 and 9 is possible without problems because these are located on the outside in front of the suction openings 2 and 3 directly at the floor of the lubricating-oil storage tank. The exchange takes place by a pressing-together of the two prongs 20 and 21 of the two-pronged bolts 16 and 17 and the subsequent pulling of the valve 8 and 9 out of the T-shaped recess 6 and 7. The pressing-together of the two prongs 20 and 21 may take place, for example, by means of two screwdrivers positioned through the slot-shaped suction mouth opening 2 and 3 when the valve 8 and 9 is opened.

According to other preferred embodiments of the invention, instead of a sealing means 12 and 13 that is injection-molded on, sealing means 12 and 13 can be made as a separate component. The component can be buttoned or clipped onto the closing plate 10 and 11. In order to achieve a firm hold on the closing plate 10 and 11 and an optimal sealing of the suction opening 2 and 3, the sealing means 12 and 13 consists of a sealing cap 32 and 33 that is hat-shaped in its cross-section having an elastic sealing lip 14 and 15 that is connected to it in the direction of the suction opening 2 and 3.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A suction housing of a lubricating-oil pump that is inserted in a lubricating-oil storage tank of a motor vehicle, having a valve arrangement that is guided in said suction housing in a direction of acceleration forces affecting said vehicle, said valve arrangement comprising: a distributing regulator having at least two receiving openings; suction openings located in said suction housing; valves that are movably arranged at said distributing regulator for controlling said suction openings such that in a moving direction of the distributing regulator, said suction opening from which said distributing regulator is moving away is closable by said valves; wherein said distributing regulator is plate-shaped and forms carrying means for mass, said mass being relatively large compared with a mass of said valves; wherein said suction housing includes a shallow groove for guiding said regulator, said regulator having a bottom side facing said groove with a sliding layer made of a low-friction material; wherein said suction valves each include closing plate means for closing a corresponding suction opening from outside said suction housing, and a bolt that is connected with said closing plate and engaged in said receiving opening.

2. A suction housing according to claim 1, wherein the closing plate means is provided with a buttoned-on sealing means.

3. A suction housing according to claim 1, further comprising guiding brackets for holding said distributing regulator inside said suction housing.

4. A suction housing according to claim 1, wherein the closing plate means is provided with a sealing means that is injection-molded on.

5. A suction housing according to claim 4, wherein the sealing means mounted on the closing plate means includes a sealing cap having an elastic sealing lip that is connected in the direction of the suction opening.

6. A suction housing according to claim 1, wherein said guiding means includes guiding brackets for maintaining the distributing regulator means in the groove.

7. A suction housing according to claim 6, wherein on an underside of the distributing regulator means facing the groove, a sliding layer is provided that is made of a material with low frictional characteristics.

8. A suction housing according to claim 1, wherein the sliding layer consists of several polytetrafluoroethylene slides arranged at the underside of the distributing regulator means.

9. A suction housing according to claim 8, wherein in the suction housing above the distributing regulator, a filter element is arranged that rests on a supporting shoulder shaped onto the interior contour of the housing.

10. A suction housing according to claim 9, wherein in the suction housing in parallel to the filter element, a by-pass valve is provided for the direct connecting of the suction opening means with a connection piece of an intake pipe arranged in the upper part of the housing.

11. A suction housing of a lubricating-oil pump for a motor vehicle, comprising:

plate-shaped distributing regulator means having a mass, guiding means for movably guiding said distributing regulator means in said suction housing in the direction of acceleration forces affecting the vehicle, suction opening means arranged at opposite sides of said suction housing at both ends of an axis along which the distributing regulator means is guided by the guiding means, and valve means for movably engaging and disengaging said suction opening means in a closed and open position respectively, wherein the valve means are movably suspended from the sides of said housing, wherein the suction means opposite the direction of movement of the distributing regulator means during acceleration is closed by the valve means, wherein the valve means are separate structures that are removable from the suction opening means, wherein the valve means consists of a valve for each of said opposite sides of the suction housing, said valve having a closing plate means for engaging the suction opening means and an outwardly radially biased engaging means, said engaging means for engaging a receiving opening means of the distributing regulator means, wherein in an engagement position said radially biased engaging means is outwardly biased into the receiving opening means of the distributing regulator means, wherein in an disengaged position said radially biased engaging means is pressed radially inward to release the valve from the receiving opening means of the distributing regulator means, wherein said radially biased engaging means includes a two-pronged bolt, wherein the closing plate means is provided with a sealing means that is injection-molded on, wherein the sealing means mounted on the closing plate means includes a sealing cap having an elastic sealing lip that is connected in the direction of the suction opening, wherein the suction opening means are slot-shaped, and wherein said guiding means includes a shallow groove in the suction housing in which the distributing regulator means travels and guiding brackets for maintaining the distributing regulator means in the groove.

12. A suction housing according to claim 11, wherein on an underside of the distributing regulator means facing the groove, a sliding layer is provided that is made of a material with low frictional characteristics.

13. A suction housing according to claim 12, wherein the sliding layer consists of several polytetrafluoroethylene slides arranged at the underside of the distributing regulator means.

14. A suction housing according to claim 13, wherein in the suction housing above the distributing regulator, a filter element is arranged that rests on a supporting shoulder shaped onto the interior contour of the housing.

15. A suction housing according to claim 14, wherein in the suction housing in parallel to the filter element, a by-pass valve is provided for the direct connecting of the suction opening means with a connection piece of an intake pipe arranged in the upper part of the housing.

* * * * *